US010971833B2

(12) United States Patent
Hashimoto et al.

(10) Patent No.: US 10,971,833 B2
(45) Date of Patent: Apr. 6, 2021

(54) BOARD CONNECTOR

(71) Applicant: Sumitomo Wiring Systems, Ltd., Mie (JP)

(72) Inventors: Norihito Hashimoto, Mie (JP); Keisuke Kanemura, Mie (JP); Motoki Kubota, Mie (JP); Liping Kang, Mie (JP); Shohei Mitsui, Mie (JP); Wataru Yamanaka, Mie (JP); Masanobu Kasuga, Mie (JP); Ai Hirano, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/726,314

(22) Filed: Dec. 24, 2019

(65) Prior Publication Data

US 2020/0203864 A1 Jun. 25, 2020

(30) Foreign Application Priority Data

Dec. 25, 2018 (JP) ..... JP2018-240659

(51) Int. Cl.
*H01R 13/62* (2006.01)
*H01R 12/70* (2011.01)
*H01R 12/72* (2011.01)

(52) U.S. Cl.
CPC ..... *H01R 12/707* (2013.01); *H01R 12/722* (2013.01)

(58) Field of Classification Search
CPC .... H01R 12/716; H01R 12/57; H01R 12/724; H01R 12/79; H01R 13/6594; H01R 13/41; H01R 13/502; H01R 12/91; H01R 13/639; H01R 12/73; H01R 2107/00; H01R 24/50; H01R 24/60; H01R 12/55; H01R 12/58; H01R 12/707; H01R 12/714; H01R 12/88; H01R 13/405; H01R 13/6471; H01R 13/6582; H01R 12/62; H01R 12/7005; H01R 12/71; H01R 12/721; H01R 12/737;
(Continued)

(56) References Cited

U.S. PATENT DOCUMENTS

2005/0003704 A1* 1/2005 Kasahara ..... H01R 12/707 439/567
2008/0290236 A1* 11/2008 Sakamoto ..... H01R 12/707 248/309.1

(Continued)

FOREIGN PATENT DOCUMENTS

JP 2012-022885 2/2012

*Primary Examiner* — Truc T Nguyen
(74) *Attorney, Agent, or Firm* — Gerald E. Hespos; Michael J. Porco; Matthew T. Hespos

(57) ABSTRACT

A board connector includes fixing members (60) to be mounted into a connector housing (10). Each fixing member (60) includes a plate-like housing mounting portion (61) to be arranged along a surface (12) of the connector housing (10) and a board fixing portion (62) connected to the housing mounting portion (61) and to be fixed to a surface of a circuit board (90) by soldering. The housing mounting portion (61) includes a flat plate (63) near the circuit board (90), a flat plate (64) distant from the circuit board (90) and a bent portion (65) between the respective flat plates (63, 64) and bulging in a plate thickness direction with respect to the flat plates (63, 64). The bent portion (65) is provided over an entire width of the housing mounting portion (61) in a plate width direction between the flat plates (63, 64).

7 Claims, 6 Drawing Sheets

(58) Field of Classification Search
CPC .... H01R 12/75; H01R 12/774; H01R 13/516; H01R 13/6275; H01R 13/631; H01R 13/6315; H01R 13/6581; H01R 13/6587; H01R 12/52; H01R 12/53; H01R 12/592; H01R 12/7076; H01R 12/7082; H01R 12/775; H01R 13/113; H01R 13/514; H01R 13/521; H01R 13/6585; H01R 13/6597; H01R 2103/00; H01R 43/0256; H01R 43/20; H01R 43/24; H01R 12/61; H01R 12/7088; H01R 12/722; H01R 12/727; H01R 12/732; H01R 13/24; H01R 13/2442; H01R 13/2457; H01R 13/426; H01R 13/504; H01R 13/506; H01R 13/518; H01R 13/5216; H01R 13/62; H01R 13/6272; H01R 13/6273; H01R 13/629; H01R 13/6335; H01R 13/6586; H01R 13/6658; H01R 2201/26; H01R 43/16; H01R 43/205; H01R 4/02; H01R 12/00; H01R 12/515; H01R 12/523; H01R 12/596; H01R 12/613; H01R 12/7011; H01R 12/7023; H01R 12/7035; H01R 12/7047; H01R 12/7064; H01R 12/77; H01R 12/771; H01R 12/777; H01R 12/82; H01R 12/85; H01R 12/87; H01R 12/89; H01R 13/03; H01R 13/04; H01R 13/05; H01R 13/08; H01R 13/10; H01R 13/11; H01R 13/111; H01R 13/112; H01R 13/193; H01R 13/2421; H01R 13/2428; H01R 13/2435; H01R 13/245; H01R 13/2464; H01R 13/2471; H01R 13/2492; H01R 13/40; H01R 13/4223; H01R 13/46; H01R 13/50; H01R 13/5025; H01R 13/512; H01R 13/5224; H01R 13/5829; H01R 13/5845; H01R 13/6205; H01R 13/622; H01R 13/625; H01R 13/627; H01R 13/62933; H01R 13/62988; H01R 13/64; H01R 13/641; H01R 13/646; H01R 13/6461; H01R 13/6473; H01R 13/6583; H01R 13/6591; H01R 13/6592; H01R 13/6593; H01R 13/6596; H01R 13/665; H01R 13/717; H01R 13/719; H01R 13/73; H01R 2201/02; H01R 2201/06; H01R 24/62; H01R 24/86; H01R 31/06; H01R 4/023; H01R 4/027; H01R 4/187; H01R 4/20; H01R 4/30; H01R 4/5066; H01R 4/62

See application file for complete search history.

(56) References Cited

U.S. PATENT DOCUMENTS

| | | | | |
|---|---|---|---|---|
| 2012/0122347 | A1* | 5/2012 | Aihara | H01R 12/707 439/660 |
| 2012/0264323 | A1* | 10/2012 | Aihara | H01R 12/707 439/345 |
| 2013/0118789 | A1* | 5/2013 | Muro | H05K 3/303 174/259 |
| 2013/0126211 | A1* | 5/2013 | Muro | H01R 12/707 174/126.1 |
| 2013/0128481 | A1* | 5/2013 | Muro | H05K 1/181 361/760 |
| 2013/0217259 | A1* | 8/2013 | Lappoehn | H01R 12/716 439/449 |
| 2017/0127545 | A1* | 5/2017 | Sakai | H01R 12/7011 |
| 2018/0048083 | A1* | 2/2018 | Doi | H01R 12/707 |
| 2020/0083624 | A1* | 3/2020 | Nagasaka | H01R 12/721 |

* cited by examiner

BOARD CONNECTOR

BACKGROUND

Field of the Invention

The invention relates to a board connector.

Related Art

Japanese Unexamined Patent Publication No. 2012-22885 discloses a shield board connector with connector housing to be mounted on a circuit board. Mounting grooves are provided in both side surfaces of the connector housing and fixing members are mountable therein.

The fixing member is a plate made of metal and includes a housing mounting part to be arranged along the side surface of the connector housing and a board fixing part bent from a lower end of the housing mounting part and to be fixed to a surface of the circuit board by soldering. The housing mounting part is a vertical plate extending along a height direction.

There has been a concern that the fixing members are peeled from the circuit board if an excessive external force is applied to the connector, for example, by a wire pulled out from a mating connector housing being swung upward with the connector housing connected to the mating connector housing. As a countermeasure, the peeling strength of the fixing members could be increased by increasing soldering areas of the fixing members to the circuit board. However, enlarging the soldering area of a small connector is difficult.

The invention was completed on the basis of the above situation and aims to prevent a fixing member mounted in a connector housing from being peeled from a circuit board.

SUMMARY

The invention is directed to a board connector with a connector housing, and a fixing member to be mounted into the connector housing. The fixing member includes a plate-like housing mounting portion to be arranged along a wall surface of the connector housing and a board fixing portion connected to the housing mounting portion and to be fixed to a surface of a circuit board by soldering. The housing mounting portion includes flat plates on a part near the circuit board and a part distant from the circuit board. A bent portion is between the flat plates in a height direction and bulges in a plate thickness direction with respect to the flat plates. Additionally, the bent portion extends over an entire width of the housing mounting portion in a plate width direction between the respective flat plates. The bent portion can absorb stress caused an external force that acts on the board connector and prevents excessive stress from being applied to the side of the housing mounting portion near the circuit board and the board fixing portion. As a result, the fixing member will not peel from the circuit board.

A plate width of the bent portion may be smaller than a plate width of each flat plate. Additionally, and the housing mounting portion may have two recesses recessed inward in the plate width direction with respect to both lateral ends of each flat plate. An external force may act on the board connector in a direction to peel the fixing member from the circuit board. However, stress generated by such an external force can be absorbed by an inner part of the housing mounting portion in the plate width direction between the respective flat plates. Thus, this stress can be concentrated on a center of the fixing member and is unlikely to be transferred to outer sides of the board fixing portion of the fixing member in the plate width direction. Accordingly, the board fixing portion will not be peeled from the circuit board from an outer end part in the plate width direction.

An edge on a back side of each recess inward in the plate width direction may be at the same height as or lower than a part on an opening end side outward in the plate width direction. An external force may act on the board connector in a direction to peel the fixing member from the circuit board. However, stress generated by such an external force can be absorbed by the part on the back side inward in the plate width direction on the edge of each recess, and the board fixing portion will not peel from the circuit board from the outer end part in the plate width direction.

An edge of each recess on the other side may be inclined toward the one side from a part on an opening end side outward in the plate width direction toward a part on a back side inward in the plate width direction. An external force may act on the board connector in a direction to peel the fixing member from the circuit board. However, stress generated by such an external force can be transferred from the part on the opening end side outward in the plate width direction on the edge of each recess on the other side toward the part on the back side inward in the plate width direction. Thus, the board fixing portion will not peel from the circuit board from the outer end part in the plate width direction.

The bent portion may bulge in a direction away from the wall surface of the connector housing, and the board fixing portion may be connected to the flat plate on the one side and project in the direction away from the wall surface of the connector housing. The bent portion and the board fixing portion include parts overlapping each other in the direction away from the wall surface of the connector housing. Thus, the fixing member is not enlarged in the direction away from the wall surface of the connector housing and a space is utilized efficiently.

DETAILED DESCRIPTION

A board connector according to the invention is described with reference to FIGS. 1 to 6 and includes a connector housing 10 to be disposed on a surface of a circuit board 90 and fixing members 60 to be mounted into the connector housing 10.

Figure 5:
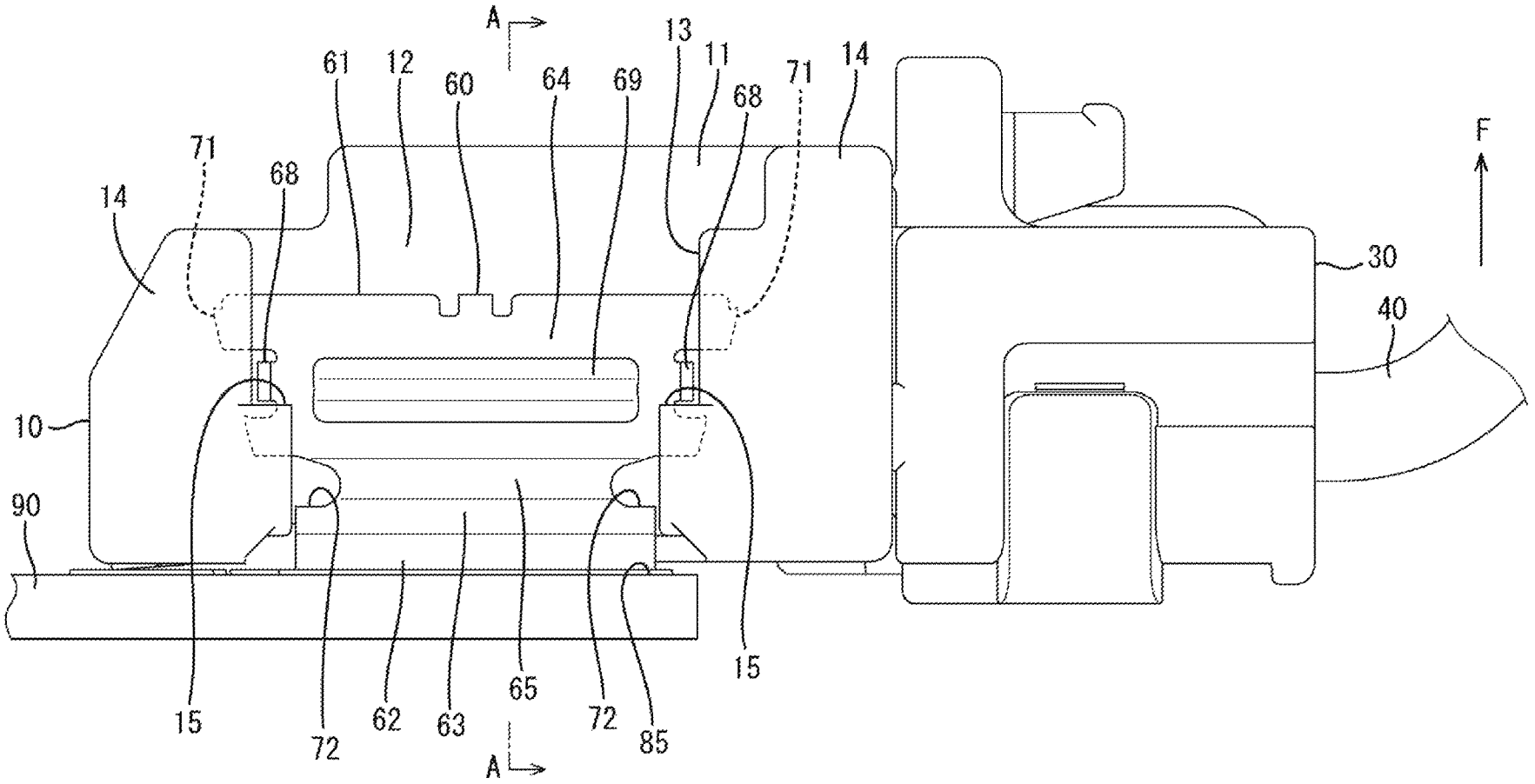
FIG. 5 is a front view in a state connected to a mating connector.

The connector housing 10 is made of synthetic resin and includes a tubular receptacle 11. As shown in FIG. 5, a mating connector housing 30 of a mating connector is fit into the receptacle 11 from a right side. An male shield terminal is mounted in the connector housing 10. Although not shown, the shield terminal includes an inner conductor terminal to be connected to a conductive portion formed on the surface of the circuit board 90 by soldering, and an outer conductor terminal to be connected to a ground by soldering.

An unillustrated female mating shield terminal is mounted in the mating connector housing 30. The mating shield terminal includes a mating outer conductor terminal to be crimped and connected to a shield layer provided on a shielded wire 40 and a mating inner conductor terminal to be crimped and connected to a conductor. The wire 40 is pulled out from the mating connector housing 30.

Mounting grooves 13 are provided in opposite side wall surfaces 12 of the connector housing 10, and the fixing members 60 are mounted respectively in the mounting grooves 13. The wall surfaces 12 (only one is shown in FIG. 5) are arranged substantially along a height direction (vertical direction) perpendicular to a plate surface direction of the circuit board 90 and perpendicular to a connecting direction of the connector housings 10, 30.

Figure 6:
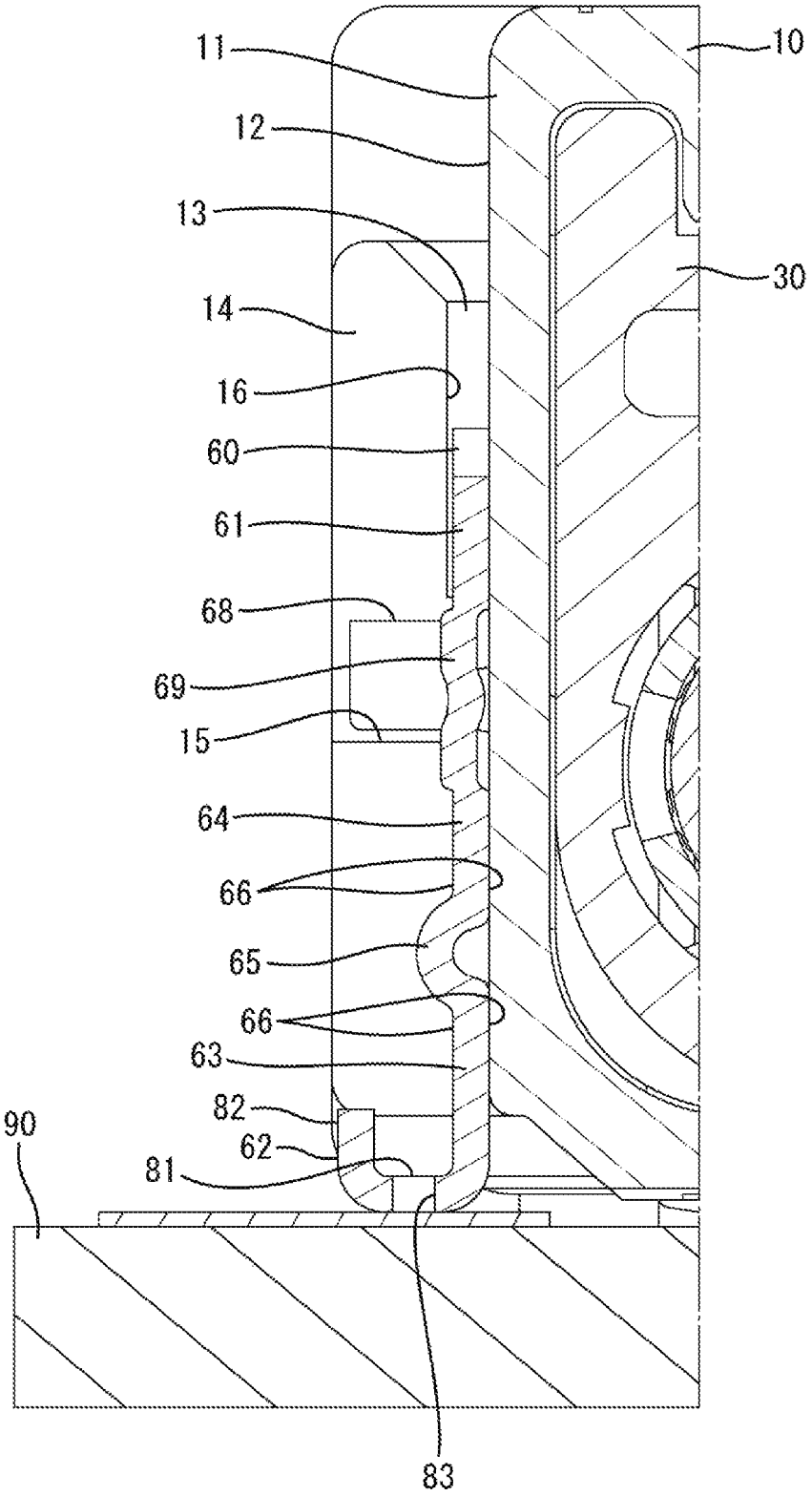
FIG. 6 is a partial enlarged section along A-A of FIG. 5.

Left and right partition walls 14 are provided on the wall surface 12 of the connector housing 10 and define both sides of the mounting groove 13. A groove back surface of each mounting groove 13 is arranged along the vertical direction between the respective partition walls 14. Each partition wall 14 includes a step 15 at a vertically intermediate position of an inner side edge facing the mounting groove 13. The mounting groove 13 is formed so that an upper groove width above the step 15 is larger than a lower groove width below the step 15. As shown in FIG. 6, each partition wall 14 includes a slit 16 continuous with the groove back surface of the mounting groove 13.

The fixing member 60 made of metal and is inserted into the mounting groove 13 of the connector housing 10 from above. As shown in FIG. 6, the fixing member 60 includes a housing mounting portion 61 to be arranged to face the wall surface 12 (groove back surface of the mounting groove 13) of the connector housing 10. A board fixing portion 62 is bent from a lower end part of the housing mounting portion and faces the surface of the circuit board 90.

As shown in FIGS. 1 to 4, the housing mounting portion 61 includes a lower flat plate 63 located on a lower side near the circuit board 90, an upper flat plate 64 located on an upper side distant from the circuit board 90 and a bent portion 65 located at a vertically intermediate position between the respective flat plates 63 and 64.

The flat plates 63, 64 have front and rear flat surfaces 66 extending vertically and laterally. Inclined edges 67 are provided on both left and right edges of the upper flat plate 64 and are tapered toward the bottom. The upper flat plate 64 also has two rectangular stoppers 68 formed between parallel cuts 88 extending in the lateral direction at intermediate positions of the respective inclined edges 67 and bent forward. The upper flat plate 64 has a rib 69 extending in the lateral direction at the same height position as the respective stoppers 68. The rib 69 has a flat base and is formed by striking a central part of the flat plate 64 forward.

Two claw-like projections 71 are provided above the respective stopper pieces 68 on the respective inclined edges 67 of the upper flat plate 64. The projections 71 bite into the respective side edges of the mounting groove 13 to be locked, as shown in FIG. 5, in a state where: the flat surfaces 66 of the flat plates 63, 64 are in contact with the groove back surface of the mounting groove 13; the respective inclined edges 67 are located in the respective slits 16; and the respective stoppers 68 contact with the respective steps 15 from above, as shown in FIG. 6. Thus, the housing mounting portion 61 is held on the wall surface 12 of the connector housing 10 in a separation restricted state.

Similar to the upper flat plate 64, the lower flat plate 63 has the flat surfaces 66 extending vertically and the laterally on entire front and rear plate surfaces. The lower flat plate 63 is a rectangle that is long in the lateral direction in a front view, and both left and right end edges are arranged vertically. A width of the lower flat plate 63 is smaller than that of the lower end of the upper flat plate 64 (smallest width of the flat plate 64).

The bent portion 65 is formed by forwardly bending a vertically intermediate part of the housing mounting portion 61, specifically a part slightly below a vertical center, to form a curved bend over the entire width. As shown in FIG. 6, the bent portion 65 bulges forward with respect to the flat plates 63, 64 to have a semicircular shape in a side view.

A plate width of the bent portion 65 is smaller than widths of the flat plates 63, 64. The housing mounting portion 61 includes two recesses 72 recessed laterally inwardly (toward a lateral center) with respect to both left and right end edges of the respective flat plates 63, 64 on both left and right end edges of the bent portion 65.

Figure 4:
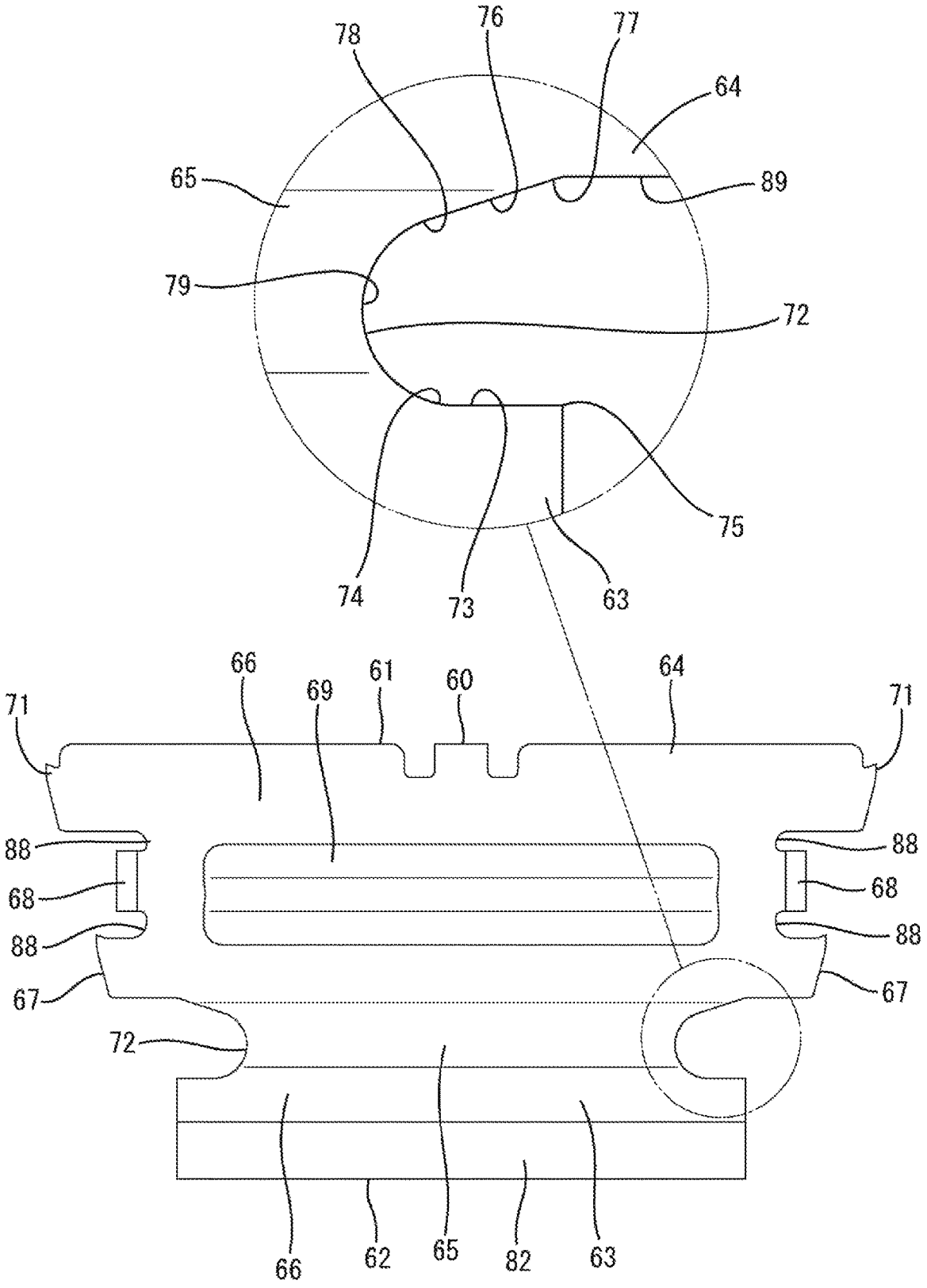
FIG. 4 is a front view of the fixing member.

Each recess 72 has a curved concave shape. As shown in FIG. 4, a lower part of each recess 72 on a side near the circuit board 90 forms a horizontal linear edge 73 extending substantially laterally from an opening of the recess 72 toward a back end on the lateral center side, and a part 74 on a back end of each recess 72 is substantially at the same height as or lower than a part 75 on the opening end. The part 75 on the opening end on the lower edge of each recess 72 is connected to the left or right edge of the lower flat plate 63.

A part of each recess 72 distant from the circuit board 90 forms an inclined edge 76 that is inclined gently down from the opening end side toward the back end side on the lateral center side so that a part 78 of the inclined edge 76 on the back end side is at a position lower than a part 77 on the opening end side, as shown in FIG. 4. The part 77 on the opening end side on the upper end edge of each recess 72 is connected to the left or right end edge of the upper flat plate 64 via a horizontal edge 89.

An arcuate curved edge 79 is at the back of each recess 72 on the lateral center side and connects the linear edge 73 to the inclined edge 76 in a curved manner. The bent portion 65 is provided within the formation range of the recesses 72 in the vertical direction.

Figure 1:
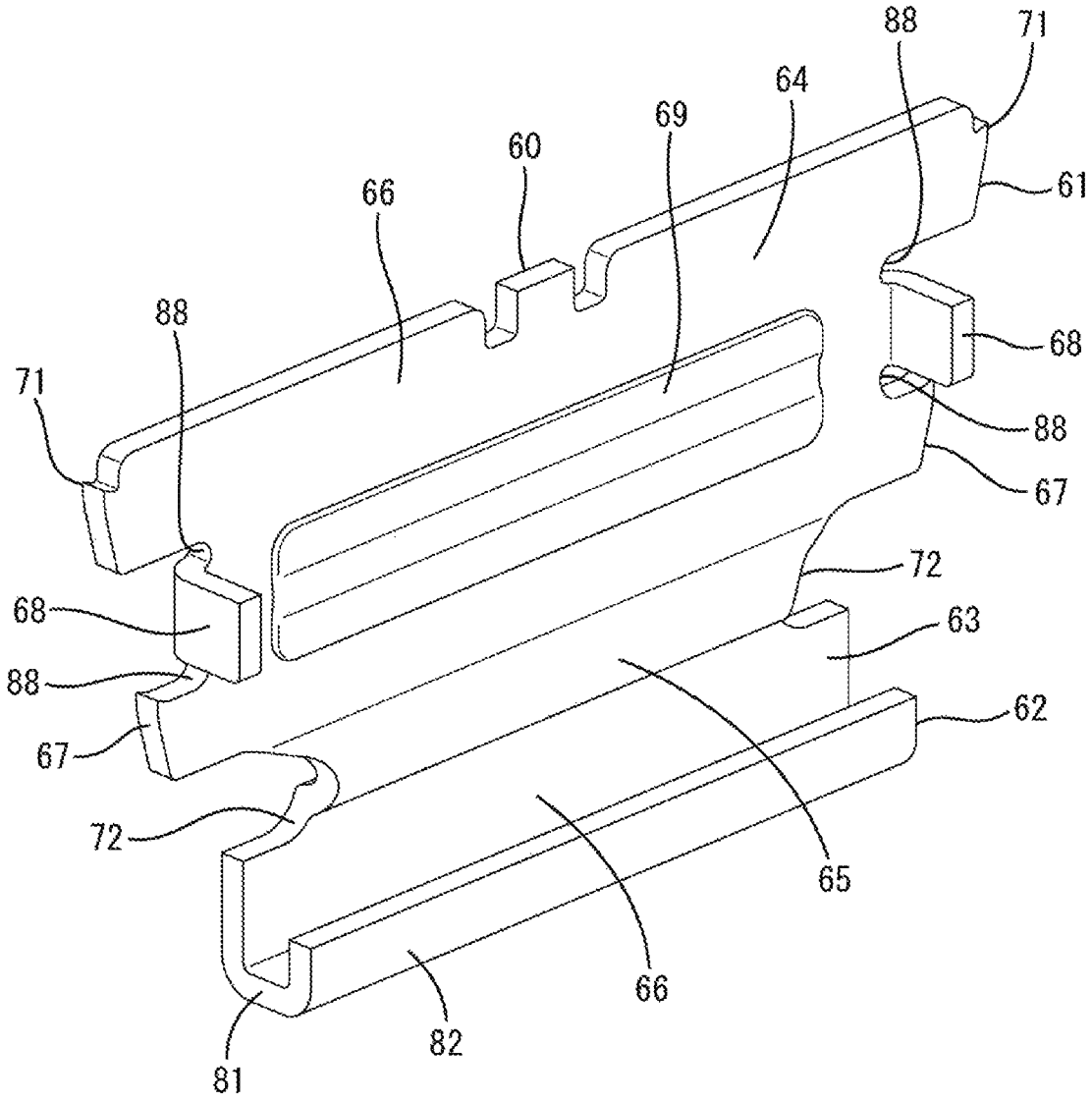
FIG. 1 is a perspective view of a fixing member viewed obliquely from an upper-front side in a board connector of one embodiment of the present invention.
Figure 2:
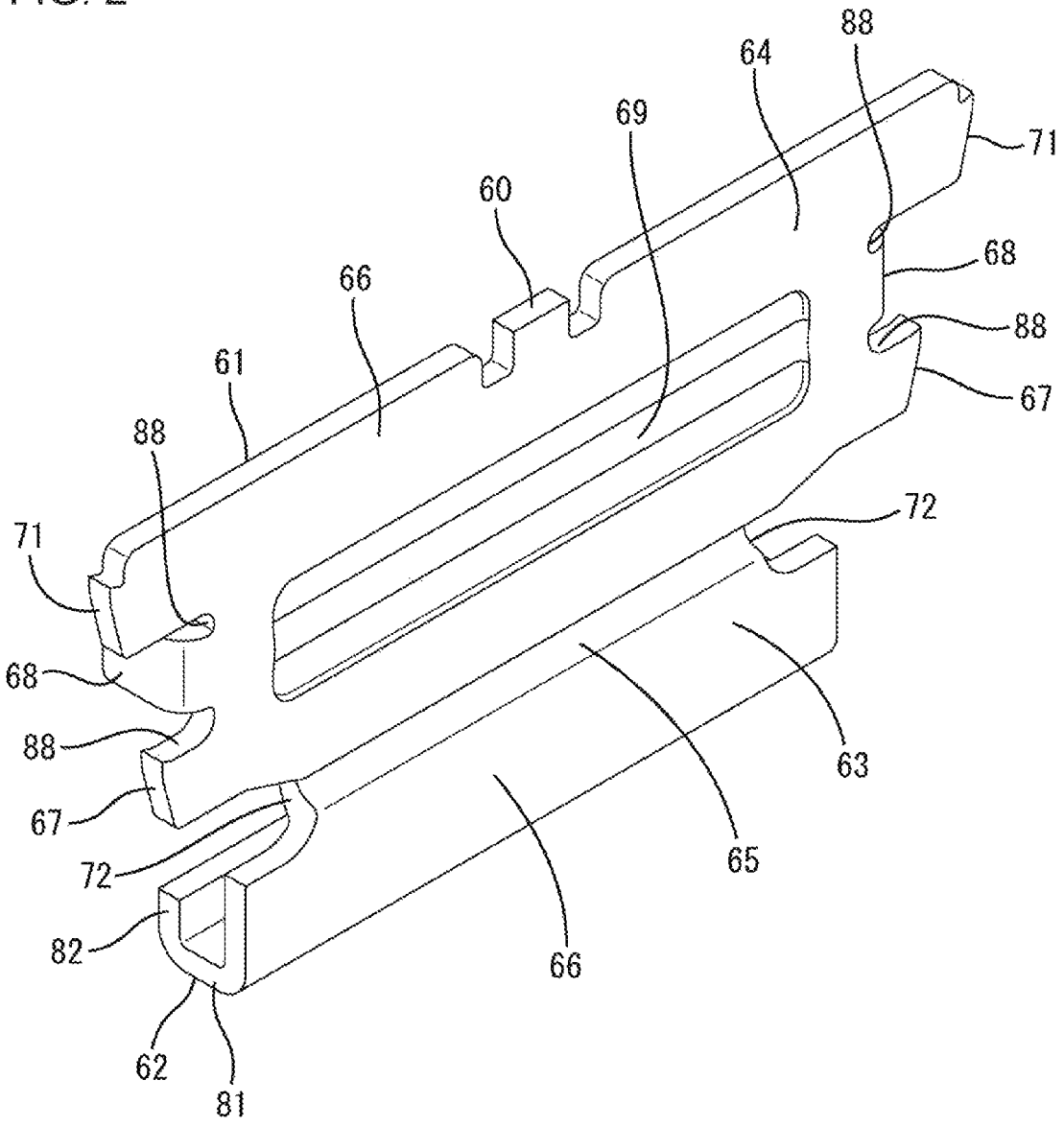
FIG. 2 is a perspective view of the fixing member viewed obliquely from an upper-rear side.
Figure 3:
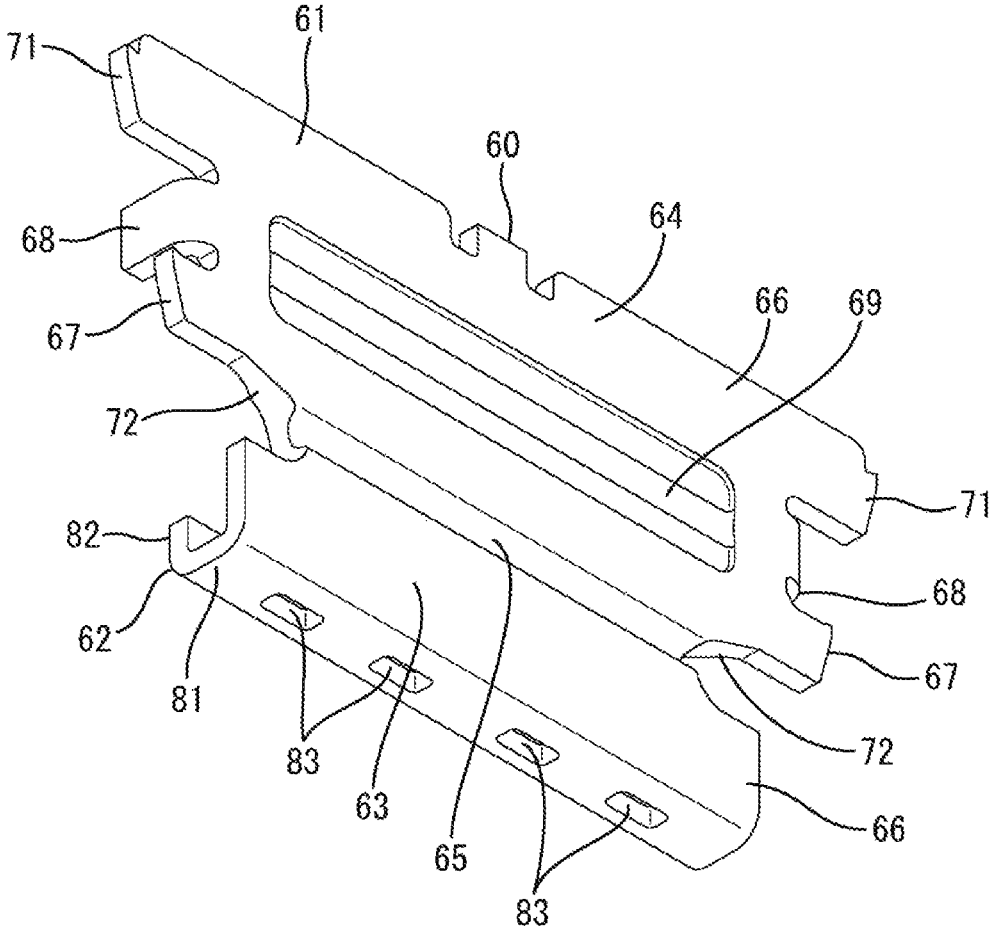
FIG. 3 is a perspective view of the fixing member viewed obliquely from a lower-rear side.

As shown in FIGS. 1 to 3, the board fixing portion 62 includes a horizontal plate 81 projecting forward from the lower end of the housing mounting portion 61 and is substantially perpendicular to the flat plate 63, and a vertical plate 82 projects up from the front end of the horizontal plate 81 to face the flat plate 63 in parallel. Both the horizontal plate 81 and the vertical plate 82 are laterally long rectangles and have a plate thickness substantially equal to that of the lower flat plate 63.

A lower end part of the fixing member 60 is formed into a U shape in a side view by the lower flat plate 63, the horizontal plate 81 and the vertical plate 82. A part of the horizontal plate 81 connected to the lower flat plate 63 overlaps the bent portion 65 in the front-rear direction. As shown in FIG. 3, the horizontal plate 81 has through holes 83 at intervals in the lateral direction. Each through hole 83 has a substantially rectangular or elliptical opening shape somewhat longer in the lateral direction.

Next, functions and effects of the board connector of this embodiment are described.

Each housing mounting portion 61 is inserted into the mounting groove 13 of the connector housing 10 from above, and each fixing member 60 is mounted into the connector housing 10 via the respective projection pieces 71 and the respective stoppers 68 (see FIG. 5). The flat surfaces 66 of the respective flat plates 63, 64 are arranged in contact along the groove back surface of the mounting groove 13, and the bent portion 65 is arranged to project forward away from the groove back surface of the mounting groove 13 (see FIG. 6). The horizontal plate 81 of the board fixing portion 62 is also arranged to project forward away from the groove back surface of the mounting groove 13.

The connector housing 10 then is placed on the surface of the circuit board 90 so that the horizontal plates 81 of the board fixing portions 62 are arranged along the surface of the circuit board 90. Subsequently, the horizontal plates 81 of the board fixing portions 62 are fixed to the circuit board 90 by soldering in a soldering step, such as reflow soldering. Solder enters the respective through holes 83 of the horizontal plates 81 and also adheres to front surface sides of vertical portions. A part of the connector housing 10 is arranged to project right from the right end of the circuit board 90 in FIG. 5 while being fixed to the circuit board 90 by the board fixing portions 62 of the respective fixing members 60.

Subsequently, the mating connector housing 30 is connected to the connector housing 10. With the connector housings 10, 30 connected, the wire 40 is pulled out from the mating connector housing 30 toward the right side of FIG. 5. If an upward external force F acts on the board connector, as shown, such as because the wire 40 is lifted up, the fixing members 60 may be peeled away from the circuit board 90 with right end parts 85 (outer end parts in a plate width direction) as starting points.

However, the bent portion 65 is provided over the entire width at the vertically intermediate position of the housing mounting portion 61 in this embodiment. Thus, stress acting on the fixing member 60 can be absorbed by the vertical center side of the housing mounting portion 61. Further, since the recesses 72 are provided at the same height position as the bent portion 65 on the both left and right end edges of the housing mounting portion 61. Therefore, the stress acting on the fixing member 60 can be absorbed by the lateral center side of the housing mounting portion 61. Thus, the stress acting on the fixing member 60 is concentrated on a center side of the housing mounting portion 61 and the transfer of the stress to the end part 85 is suppressed. As a result, even if the external force F acts on the board connector, the fixing member 60 will not peel from the circuit board 90 with the end 85 as a starting point.

More particularly, the lower part of each recess 72 includes the linear edge 73 and the part 74 on the back end side on the lower end of each recess 72 is arranged substantially at the same height position as or at the position lower than the part 75 on the opening end side. Thus, the stress can be more concentrated on the center side of the housing mounting portion 61 and the fixing member 60 is prevented more reliably from being peeled from the circuit board 90 upon receiving the external force F.

The upper part of each recess 72 includes the inclined edge 76 and is inclined down from the part 77 on the opening end side toward the part 78 on the back end side. Thus, the stress is transferred easily toward the center of the housing mounting portion 61 and the fixing member 60 reliably is prevented from being peeled from the circuit board 90 upon receiving the external force F. Therefore, a state where the fixing members 60 are soldered to the circuit board 90 can be maintained satisfactorily.

Furthermore, the bent portion 65 and the board fixing portion 62 partly overlap each other in the front-rear direction (direction away from the wall surface 12 of the connector housing 10). Thus, the fixing member 60 is not enlarged in the front-rear direction.

The invention is not limited to the above described and illustrated embodiment. For example, the following various modes are also included in the technical scope of the present invention.

The bent portion may include an acutely bent part.

The opening shape of the recess may include an acutely bent part.

The invention also is applicable to board connectors of a non-shield type having no shielding function.

LIST OF REFERENCE SIGNS

10 . . . connector housing
12 . . . wall surface
60 . . . fixing member
61 . . . housing mounting portion
62 . . . board fixing portion
63 . . . (lower) flat plate
64 . . . (upper) flat plate
65 . . . bent portion
72 . . . recess
90 . . . circuit board

What is claimed is:

1. A board connector, comprising:

a connector housing; and a fixing member to be mounted into the connector housing;

wherein:

the fixing member includes a plate-like housing mounting portion having a rear surface extending between opposed first and second side edges and to be arranged along a wall surface of the connector housing and a board fixing portion connected to the housing mounting portion and to be fixed to a surface of a circuit board by soldering;

the housing mounting portion includes a lower flat plate on a side near the circuit board and an upper flat plate distant from the circuit board, the lower flat plate and the upper flat plate arranged in contact with the wall surface, and a bent portion bulging forward in a plate thickness direction with respect to the respective lower and upper flat plates and disposed between the respective lower and upper flat plates in a height direction so as to be spaced forward from the wall surface; and the bent portion extends from the first side edge to the second side edge of the housing mounting portion in a plate width direction between the respective flat plates.

2. The board connector of claim 1, wherein:

a plate width of the bent portion is smaller than a plate width of each lower and upper flat plates; and the housing mounting portion is provided with two recesses recessed inwardly in the plate width direction with respect to both ends of each flat plate portion in the plate width direction on both ends of the bent portion in the plate width direction.

3. The board connector of claim 2, wherein each of the recesses has an open end and a closed end, an edge of each of the recesses near the closed end being at a height equal to or lower than a corner of the recess at the open end that is closest to the circuit board.

4. The board connector of claim 3, wherein an edge of each of the recesses facing toward the circuit board is inclined down toward the closed end in the plate width direction.

5. The board connector of claim 4, wherein:

the bent portion bulges in a direction away from the wall surface of the connector housing; and the board fixing portion is connected to the lower flat plate and projects away from the wall surface of the connector housing.

6. The board connector of claim 2, wherein an edge of each of the recesses facing toward the circuit board is inclined down toward the closed end in the plate width direction.

7. The board connector of claim 1, wherein:

the bent portion bulges in a direction away from the wall surface of the connector housing; and the board fixing portion is connected to the lower flat plate and projects away from the wall surface of the connector housing.

* * * * *